United States Patent [19]

Polk

[11] 4,350,847

[45] Sep. 21, 1982

[54] SUBWOOFER SYSTEM USING A PASSIVE RADIATOR

[75] Inventor: Matthew S. Polk, Baltimore, Md.

[73] Assignee: Polk Audio, Inc., Baltimore, Md.

[21] Appl. No.: 224,451

[22] Filed: Jan. 12, 1981

[51] Int. Cl.[3] ..... H04R 5/02; H04S 1/00

[52] U.S. Cl. ..... 179/1 GA; 179/1 G; 181/155; 181/163

[58] Field of Search ..... 179/1 G, 1 GA, 1 E; 181/145, 151, 154, 155, 163

[56] References Cited

U.S. PATENT DOCUMENTS

| | | | |
|---|---|---|---|
| 4,207,963 | 6/1980 | Klasco | 181/155 X |
| 4,276,446 | 6/1981 | Taddeo | 181/145 X |
| 4,326,099 | 4/1982 | Maille | 179/1 G |

FOREIGN PATENT DOCUMENTS

| | | | |
|---|---|---|---|
| 55-73197 | 6/1980 | Japan | 179/1 GA |

*Primary Examiner*—R. J. Hickey

*Attorney, Agent, or Firm*—Cushman, Darby & Cushman

[57] ABSTRACT

A loudspeaker subwoofer system is disclosed which combines signals from more than one audio channel. A single enclosure mounts an active driver for each of a plurality of audio channels, which active drivers are respectively connected to each respective audio channel. A passive radiator loudspeaker is also mounted in the single enclosure. The passive radiator is acoustically coupled to the active drivers and functions as a subwoofer.

5 Claims, 3 Drawing Figures

SUBWOOFER SYSTEM USING A PASSIVE RADIATOR

BACKGROUND OF THE INVENTION

This invention pertains to a loudspeaker apparatus, and more particularly pertains to a subwoofer loudspeaker system which utilizes a passive radiator.

A common limitation of loudspeaker systems, particularly those intended for high quality stereo sound reproduction, is relatively inadequate low frequency performance. Of course, one possible solution for those who are not satisfied with the low frequency performance of their stereo loudspeakers is to replace them with larger (and more expensive) loudspeaker systems. Another possibility is the addition of what is known as subwoofer systems to existing loudspeaker systems. However, there are several problems that have adversely affected the performance and marketability of subwoofer systems.

One of the most serious problems affecting the saleability of a subwoofer is that two subwoofers must be used, one for each of the channels in a stereo high-fidelity system. This effectively doubles the price. Since very low frequency sound (i.e. below 150 Hz) tends to have no directional effects in a stereo system, the improvement in low frequency performance afforded by a single subwoofer would be adequate in most cases. However, the use of a single subwoofer to which the stereo channels were coupled would unbalance the stereo channels.

Several previous designs have attempted to combine the electrical signals from the two stereo channels so that a single center channel subwoofer can be used. This is somewhat difficult in view of the substantial electrical power and low frequencies involved. Usually, it is accomplished through a "matrix" type crossover which includes both the large inductors required for the low crossover frequency and the transformers required to mix the two channels. One example of this general kind of arrangement in which the signals on the channels are electrically summed to feed a single low frequency speaker, is shown in U.S. Pat. No. 3,637,938.

Such an approach entails several problems. It is expensive and requires common ground outputs from an amplifier. Further, it is electrically inefficient and has poor performance due to inevitable saturation of transformer cores. Moreover, it also offers no flexibility and is too complicated for most consumers.

Another prior approach has been simply to build two subwoofers into a single divided cabinet, with or without separate built-in crossovers. This obviously reduces the cabinet cost but is otherwise equal to the cost of two separate subwoofers, and would result in a very bulky cabinet.

SUMMARY OF THE INVENTION

Accordingly, it is an object of this invention to provide a loudspeaker system which overcomes the deficiencies of these prior approaches.

More specifically, it is an object of this invention to provide a novel apparatus and method for summing at one loudspeaker the signals on a plurality of sound channels.

It is a still more specific object of this invention to provide a subwoofer system including a single enclosure containing two active driver loudspeakers for direct electrical coupling to two signal channels, and a single passive radiator acoustically coupled to the driver loudspeakers.

Briefly, in accordance with one embodiment of the invention, there is provided a loudspeaker housing. At least two actively driven loudspeakers are mounted in the housing, and means are provided for respectively electrically coupling the actively driven loudspeakers to at least two signal sources. A passive radiator loudspeaker is also mounted in the housing. The passive radiator has no direct electrical connections, but rather is acoustically coupled to the actively driven loudspeakers by the air mass contained within the loudspeaker housing. In this manner the signals from the at least two signal sources are acoustically coupled to the passive radiator loudspeaker without the necessity of any electrical coupling means.

Other objects and advantages of the present invention will appear from the detailed description of one embodiment thereof, taken in conjunction with the drawings.

DETAILED DESCRIPTION

Figure 1:
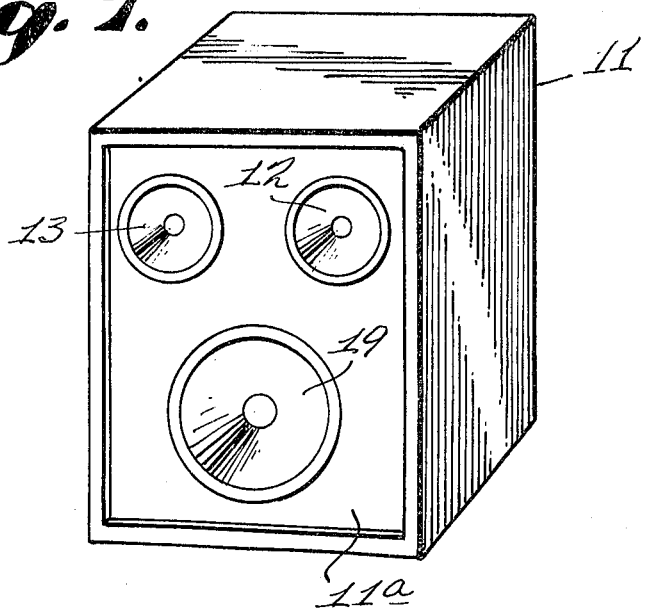
FIG. 1 is an oblique view of a typical loudspeaker housing (with the grille removed) illustrating an exemplary mounting of individual loudspeakers.
Figure 2:
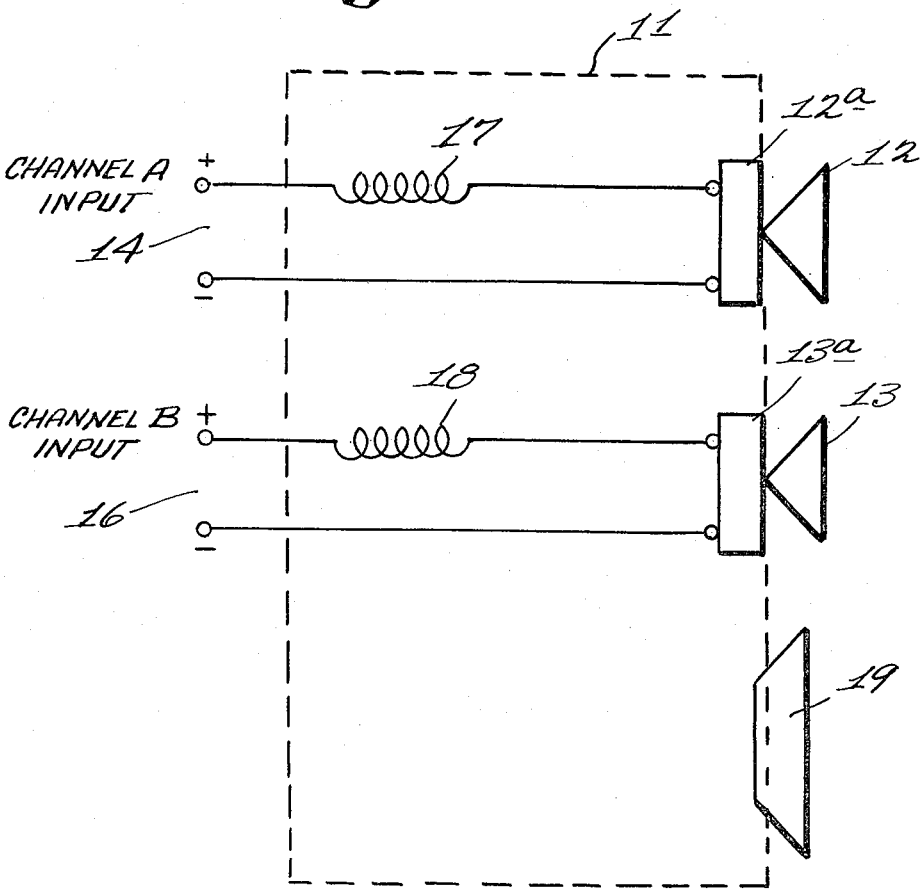
FIG. 2 is a circuit diagram of one embodiment of the invention illustrating the electrical connections to the active driver loudspeakers.

Referring now to FIGS. 1 and 2, there is illustrated a typical loudspeaker housing 11. Although loudspeaker enclosures typically have a grille of some kind the housing 11 is shown without any grille, for clarity of illustration. In accordance with one embodiment of the invention two active driver loudspeakers 12 and 13 are mounted in the front 11*a* of the housing 11. The active driver speakers 12 and 13 have voice coil and magnet structures 12*a* and 13*a*, which are respectively electrically connected to terminals 14 and 16. As shown in FIG. 2, the coupling of the voice coil and magnet structures 12*a* and 13*a* to the terminals 14 and 16 may include inductors 17 and 18, respectively, forming first order low pass filters. These filters can serve as crossover networks in a manner akin to crossover networks for loudspeaker systems as known to those skilled in this art. For a woofer or subwoofer part of a loudspeaker system, it is desirable to eliminate as much as possible all mid and high frequency components, as known to those skilled in this art.

As shown in FIG. 2, the terminals 14 and 16 are adapted for connection to two respective signal inputs, labeled channels A and B in the drawing. For a stereo system, these can correspond to the left and right channels.

FIGS. 1 and 2 also illustrate a passive driver 19 mounted to the enclosure 11. As can be seen in FIG. 2, the passive driver 19 does not have any electrical connections thereto, nor does it have any magnet and voice coil structure. The passive radiator 19 simply comprises a diaphragm of suitable design for operating in its intended range, i.e. low frequency. In operation, acoustic energy generated inside housing 11 by the active driver loudspeakers 12 and 13 is transmitted or coupled, via the air mass within the enclosure 11, to the low frequency passive radiator. In accordance with one embodiment of the invention, values of the filters are selected in accordance with the loudspeaker sizes so that the system impedance is generally high below 80 Hz and drops rapidly at higher frequencies. This contributes to a faster roll-off of the illustrated first order low pass filter shown and hence improves performance at a lower cost. With this arrangement, the necessary electrical separation between the channels is maintained, and the outputs at the two active driver loudspeakers is acoustically summed at frequencies below the acoustic turnover to the passive radiator.

The prior art does include examples of loudspeaker systems in which there might be one component which is not electrically connected to the signal source, i.e. a passive radiator. These include U.S. Pat. Nos. 1,988,250; 3,772,466; and 3,780,824.

Some of these prior art systems use the air mass in the enclosure to acoustically couple a signal on a smaller active driver loudspeaker to a larger passive radiator. However, the prior art appears not to have realized that such a technique, when applied according to the principles of this invention, can be used to advantage to construct a single subwoofer for a stereo system without the necessity for complex matrix electrical coupling between the channels.

Optimized design of a loudspeaker system in accordance with the present invention requires that attention be paid to several parameters. The in-cabinet resonances of the low frequency passive radiator 19 and the active driver loudspeakers 12 and 13 will determine the acoustic crossover point and the mechanical Q of each system will determine the slope of the crossover. The enclosure volume, as related to the piston area of the active drive speakers, will sharpen the high-end rolloff of the low frequency passive radiator and will determine the degree of acoustic coupling between the active driver loudspeakers and the passive radiator. An additional advantage may accrue from the use of relatively small active driver speakers to drive the larger low frequency passive radiator in that the mechanical advantage obtained results in improved transient response and a high mechanical damping factor.

In accordance with a specific presently preferred best mode embodiment of the invention as illustrated in FIGS. 1 and 2, the two active drivers 12 and 13 have the following parameters:

Diaphragm diameter—5"
B1 product—5.8 weber/meter
DC resistance—6.4Ω
Free air resonance—22 Hz
Mechanical Q—1.0

The volume of enclosure 11 is 2.1 cu. ft. The passive radiator 19 has a diaphragm 9½" in diameter weighing 140 grams (approx.). The system resonance of the active drivers is approximately 50 Hz and the system resonance of the passive radiator is approximately 16 Hz.

Each active driver is connected to one channel of a stereo amplifier through a series inductor 17 or 18 whose value is approximately 11.2 mH. This value is chosen to provide a 3 db down point at 60 Hz. In addition, each inductor has a center tap allowing a choice of 5.6 mH giving a 3 db down point of 100 Hz.

In general, the system can be considered to be two vented systems each with a single driver and passive radiator mounted in a cabinet whose volume is equal to the entire cabinet volume. The system parameters can then be determined by the methods outlined by Thiele & Small in papers in the Journal of the Audio Engineering Society. (A. N. Thiele, "Loudspeakers in Vented Boxes: Part I", May 1971 JAES. and R. H. Small, "Vented Box Loudspeaker System—Parts 1, 2, 3, 4", June through October 1973, JAES).

Figure 3:
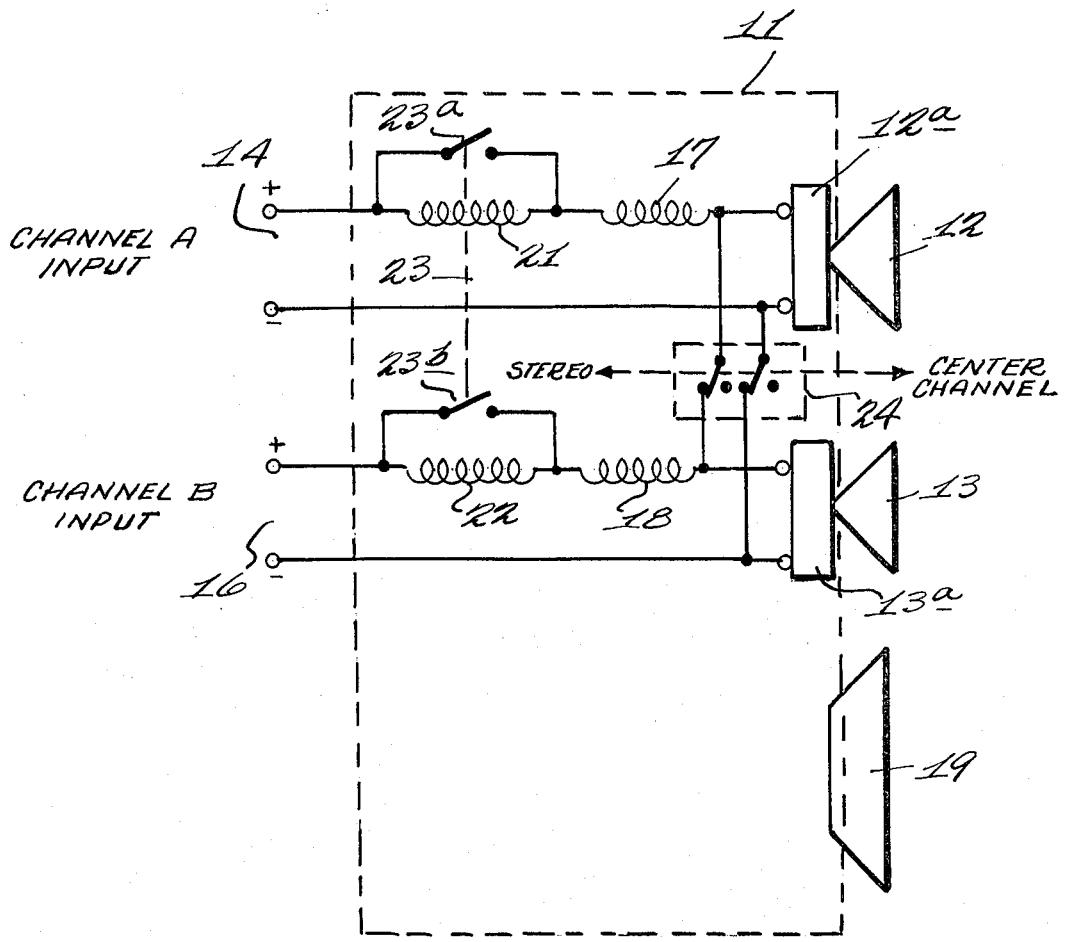
FIG. 3 is a circuit diagram illustrating aspects of an alternate embodiment of the invention.

Turning now to a consideration of FIG. 3, there are shows aspects of possible alternate embodiments of the invention. In FIG. 3, components that correspond to the components in FIG. 2 are given identical reference numerals. Thus two active driver loudspeakers 12 and 13 and a passive radiator loudspeaker 19 are mounted in e.g., the front panel of enclosure or housing 11. The active driver loudspeakers 12 and 13 are respectively coupled through low pass filters 17 and 18 to channel A and B signal inputs at terminals 14 and 16. As shown in FIG. 3, additional filter elements 21 and 22 can be respectively provided in series with the filter channels 17 and 18. A double pole, single throw switch 23 having switch contacts **23*a* and 23*b* is provided. By manual operation of the switch 23, the filter elements 21 and 22 can be either left in the system (when switch 23 is open) or electrically removed by short-circuiting when the switch 23** is closed. In this manner, the crossover point and/or efficiency of the system can be adjusted.

Also, referring to FIG. 3, an additional double pole, single throw switch 24 can be provided. With such a switch in the stereo position as shown in FIG. 3, both terminals 14 and 16 would be connected to the same input signal, i.e., both channels A and B would be the same, and two loudspeaker systems such as shown in FIG. 3 would be provided, one for each stereo channel. Alternatively, with the switch 24 in the center channel position, each of the active driver loudspeakers 12 and 13 would be fed a different signal, so that the loudspeaker system of FIG. 3 would function as a center channel loudspeaker subwoofer system. Provision of the switch 24 would provide the maximum system flexibility.

While the present invention has been described by reference to presently preferred embodiment thereof, it should be understood that various modifications within the skill of those in this art may be made, without departing from the true spirit and scope of the invention.

What is claimed is:

1. A loudspeaker apparatus for use in a stereo sound reproducing system having a left channel signal and a right channel signal comprising a housing containing an air mass, a left channel loudspeaker and a right channel loudspeaker mounted in said housing, each of said left and right channel loudspeakers having voice coils, respective means for connecting the left channel signal to said left channel loudspeaker voice coil and the right channel signal to said right channel loudspeaker voice coil, a passive radiator loudspeaker mounted in said enclosure and acoustically coupled by the air mass to said left and right channel loudspeakers for acoustically summing their acoustic outputs.

2. A loudspeaker apparatus in accordance with claim 1 wherein said respective means for connecting the left and right channel signals to said left and right channel speakers each includes an inductor forming low pass filters.

3. A loudspeaker apparatus in accordance with claim 2 wherein said respective means each includes an additional inductor and switching means for selectively short-circuiting said additional inductor, so that the low pass filter characteristics of the loudspeaker apparatus can be selectively altered.

4. A loudspeaker apparatus in accordance with claim 1 wherein said passive radiator is of a substantially larger size than said active driver loudspeakers, said passive radiator intended for sound reproduction of low frequency signal components.

5. A loudspeaker system in accordance with claim 1 including switch means for connecting the at least two active driver loudspeakers in parallel.

* * * * *